US005774053A

United States Patent [19]

Porter

[11] Patent Number: 5,774,053

[45] Date of Patent: Jun. 30, 1998

[54] STORAGE DEVICE FOR THE DELIVERY AND PICKUP OF GOODS

[76] Inventor: David Porter, 442 W. 62nd Ter., Kansas City, Mo. 64113

[21] Appl. No.: 643,038

[22] Filed: May 2, 1996

[51] Int. Cl.[6] ..... G08B 13/14

[52] U.S. Cl. ..... 340/568; 232/19; 235/381; 312/287; 340/543; 340/825.35

[58] Field of Search ..... 340/568, 543, 340/539, 693, 569, 571, 825.35, 825.34, 825.31; 235/381; 312/242, 287; 232/19, 17; 70/DIG. 49, 432, 441; 109/38, 44

[56] References Cited

U.S. PATENT DOCUMENTS

| | | | |
|---|---|---|---|
| 2,088,806 | 8/1937 | Ottmann | 232/34 X |
| 3,130,395 | 4/1964 | Simjian | 340/569 X |
| 3,591,194 | 7/1971 | Vega | 220/259 |
| 4,314,102 | 2/1982 | Lowe et al. | 340/569 X |
| 4,596,203 | 6/1986 | Lorek | 340/542 X |
| 5,009,018 | 4/1991 | Sebag | 40/306 |
| 5,036,310 | 7/1991 | Russell | 340/569 |
| 5,118,175 | 6/1992 | Costello | 312/242 |
| 5,153,561 | 10/1992 | Johnson | 340/571 |
| 5,190,213 | 3/1993 | Horwitz | 229/152 |
| 5,223,829 | 6/1993 | Watabe | 340/568 X |
| 5,257,509 | 11/1993 | Harris | 62/326 |
| 5,263,339 | 11/1993 | Evans | 62/457.7 |
| 5,270,686 | 12/1993 | Martinez | 340/689 |
| 5,407,218 | 4/1995 | Jackson | 280/30 |
| 5,485,139 | 1/1996 | Tarnovsky | 340/573 |

FOREIGN PATENT DOCUMENTS

| | | | |
|---|---|---|---|
| 2269469 | 2/1994 | United Kingdom | 340/825.34 |

*Primary Examiner*—Thomas Mullen
*Attorney, Agent, or Firm*—Hovey, Williams, Timmons & Collins

[57] ABSTRACT

A storage device (10) that secures goods from theft and exposure to the elements and that provides a notification that goods have been delivered and/or picked up is disclosed. The storage device (10) includes an enclosure (14) for enclosing the goods and a communication apparatus (16) for providing notification that goods have been delivered or picked up.

18 Claims, 2 Drawing Sheets

10
12
14
16
18
20
22
24
26
28
30
32
34
36
38
42
44
50
52
4

STORAGE DEVICE FOR THE DELIVERY AND PICKUP OF GOODS

BACKGROUND OF THE INVENTION

1. Field of the Invention

The present invention relates to storage devices for the delivery and pickup of goods, and more particularly to a storage device that secures goods from theft and exposure to the elements and that provides a notification that goods have been delivered to and/or picked up from the storage device.

2. Description of the Prior Art

Home delivery of goods has become an increasingly popular way for consumers to reduce shopping time. For example, many retail stores allow consumers to order clothes, appliances, furniture and other goods from catalogues for direct delivery to their homes. Similarly, many laundry and dry cleaning businesses pick up and deliver laundry directly to consumers' homes, and many grocery stores deliver groceries directly to consumers' homes.

The recent growth of the Internet has further accelerated this trend towards home delivery. For example, many major retailers such as Wal Mart are developing Internet sites that permit consumers to see three-dimensional images of their goods and order these goods while on-line. The goods are then shipped directly from the manufacturer to the consumer rather than to the retailer.

Home delivery of goods not only saves consumers time and money, but it also has the potential to significantly reduce gas consumption and automobile pollution since consumers won't have to drive to conventional stores to buy and pick up groceries, laundry, clothing and other goods. However, home delivery has not yet gained wide-spread consumer acceptance because there are currently no means to insure safe, convenient, and unobtrusive delivery of the goods.

If consumers currently place orders for the home delivery of goods, they must either (1) be at home when the goods are delivered, (2) make arrangements for the goods to be left at their door unattended or with a neighbor, or (3) provide the vendor or delivery person with keys to their home.

None of these options are satisfactory because they are not safe, convenient, and/or unobtrusive. Particularly, requiring consumers to wait at home for the delivery of their goods or to make arrangements with neighbors is not convenient and therefore defeats the purpose of home delivery. Moreover, even when the consumers are home, they often do not wish to be disturbed by delivery people. Similarly, leaving the goods outside the consumers' homes may result in theft or damage of the goods. Finally, providing vendors with keys raises privacy and security concerns, especially as the number of vendors making home deliveries to a particular home increases. The lack of a convenient delivery means is especially problematic for the home delivery of groceries since groceries often must be promptly refrigerated.

Another problem with home delivery of goods is that consumers are often not notified when the goods are delivered or picked up. For example, if goods are left outside of a consumers' home early in the morning, the consumers often will not see the goods until they return from work in the evening. Leaving the goods unattended for such a long time obviously increases the risks of theft or damage.

OBJECTS AND SUMMARY OF THE INVENTION

In view of the foregoing, it is an object of the present invention to provide an improved storage device for the delivery and pickup of goods that encourages consumers to take advantage of the benefits of home delivery.

It is a more particular object of the present invention to provide a storage device that protects delivered goods from theft and/or damage.

It is another object of the present invention to provide a storage device that preserves refrigerated food items after they are delivered.

It is another object of the present invention to provide a storage device that notifies the homeowner when goods have been delivered.

It is another object of the present invention to provide a storage device that notifies a vendor that goods are to be picked up once the homeowner places the goods in the storage device.

In view of these objects and other objects that become evident from the description of the preferred embodiments of the invention herein, an improved storage device is disclosed. The storage device broadly includes an enclosure for enclosing delivered goods or goods that are to be picked up and a communication apparatus operably coupled with the enclosure for controlling entry to the enclosure and for providing a notification that goods have been delivered to or picked up from the enclosure.

In more detail, the enclosure includes a door, a lock for locking the door, and a lock operator for unlocking the lock. In preferred forms, the lock operator includes a keypad for permitting the entry of a plurality of keycodes.

The preferred communication apparatus includes a controller coupled with the keypad and lock operator and a transmitting device responsive to the controller. The controller includes conventional memory for storing a plurality of vendor codes each associated with a separate vendor and a plurality of vendor messages each associated with one of the vendor codes.

Each vendor that makes deliveries to the storage device is assigned and notified of a unique vendor code. When a vendor makes a delivery, the vendor enters its vendor code into the keypad. The controller verifies that the entered keycode is accurate and then unlocks the door if it is. The controller also retrieves the vendor message associated with the entered vendor code and directs the transmitting device to transmit the vendor message to a location remote from the storage device for providing a notification that a delivery has been made. In preferred forms, the transmitting device transmits the vendor message to a communication apparatus located in the homeowner's home or business.

The storage device also preferably includes an insulated compartment and a refrigeration unit for cooling the insulated compartment. The controller turns on the refrigeration unit whenever a vendor that delivers frozen or refrigerated items enters its vendor code into the keypad.

By constructing a storage device as described herein, numerous advantages are realized. For example, by constructing a storage device having an enclosure with a door, a lock, a lock operator, and a communication apparatus for controlling the entry to the enclosure, goods can be safely delivered to and/or picked up from he storage device without fear of theft and damage.

Additionally, by constructing a storage device with a communication apparatus that notifies a homeowner when goods have been delivered or notifies a vendor that goods are ready to be picked up, consumers and vendors can more easily monitor deliveries to the storage device and can arrange to remove the goods from or place goods into the storage device.

Additionally, by constructing a storage device with a communication apparatus that stores a plurality of vendor codes and compares entered codes to these stored vendor codes, a plurality of vendors can make deliveries to the storage device, and the communicating apparatus can identify which vendor has made a delivery and provide the homeowner with a unique notification message for each vendor.

Additionally, by constructing a storage device with an insulated compartment and a refrigeration unit for cooling the insulated compartment, refrigerated or frozen food items can be delivered to the storage device and preserved until the homeowner retrieves them from the storage device. Moreover, by coupling the refrigeration unit with the controller, the refrigeration device can be automatically turned on when particular deliveries are made to the storage device.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figures 1, 2, 3, 4:
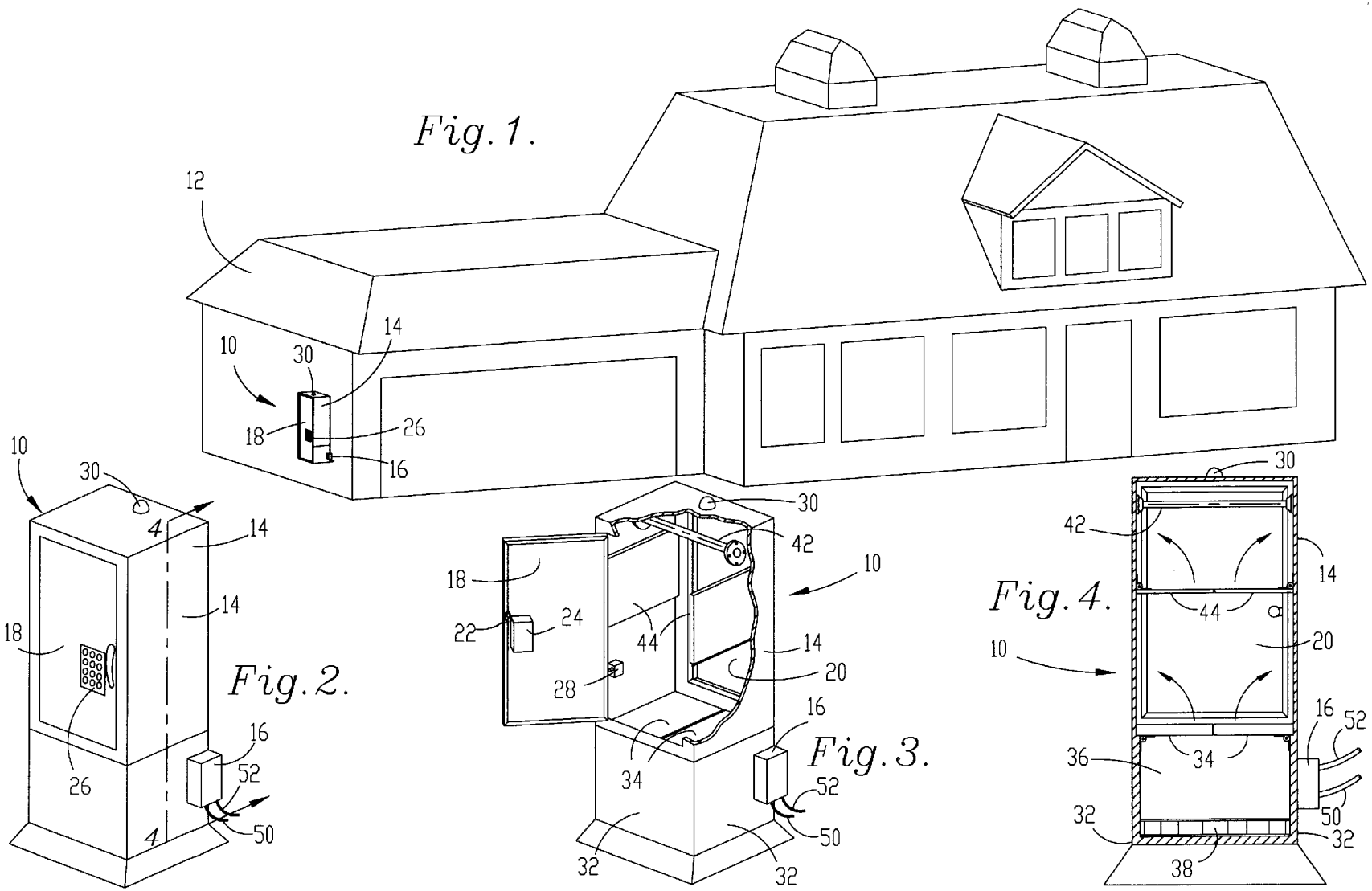
FIG. 1 is a perspective view of a storage device constructed in accordance with a first preferred embodiment of the invention showing the storage device attached to a home.
FIG. 2 is a perspective view of a storage device constructed in accordance with a second embodiment of the invention showing the storage device as a stand-alone unit.
FIG. 3 is a perspective view of the storage device illustrated in FIG. 2 with parts broken away and showing the doors of the storage device open.
FIG. 4 is a section view of the storage device taken along line 4—4 of FIG. 2.

The storage device 10 of the present invention may be constructed in accordance with three preferred embodiments. FIG. 1 illustrates a first embodiment of the invention wherein the storage device 10 is configured for attachment to a building such as a home 12 or business. The storage device is attached to the home 12 by conventional attachment hardware such as bolts or brackets. FIGS. 2–4 illustrate a second embodiment of the invention wherein the storage device 10 is configured as a stand-alone unit for placement near the home 12 or business. In a third embodiment of the invention, the storage device is configured for attaching through the wall of a building such as a home or business for permitting access from both sides of the storage device.

All embodiments of the storage device 10 broadly include an enclosure 14 for enclosing delivered goods or goods that are to be picked up and a communication apparatus 16 for controlling access to the enclosure 14 and for providing notification that goods have been delivered to or picked up from the enclosure 14.

In more detail, the enclosure 14 may be constructed of any suitable material such as wood, plastic or metal and is preferably approximately 66" tall, 24–30" wide, and 24" deep. The enclosure may include removable panels in different colors and textures that can be attached to the exterior of the enclosure to permit homeowners to personalize the look of the enclosure or to match the color of the home.

As best illustrated in FIG. 3, the enclosure 14 includes a front hinged door 18 for permitting access to the front of the enclosure 14 and may include a rear hinged door 20 for permitting the homeowner to retrieve goods from or place goods in the rear of the enclosure 14. In the first embodiment of the storage device 10 illustrated in FIG. 1, the rear hinged door 20 may extend through an exterior wall of the home 12 so that the homeowner can access the storage device 10 while inside the home 12.

The front door 18 of the enclosure 14 includes a lock 22 for locking the door 18 and a lock operator 24 for unlocking the lock 22. In preferred forms, the lock operator 24 includes a conventional alphanumeric keypad 26 for permitting the entry of keycodes. As described in more detail below, the lock operator 24 unlocks the lock 22 only when a correct keycode is entered into the keypad 26. The lock operator 24 may also be coupled with other types of entry controlling devices such as a card reader, voice recognition device, fingerprint identification system, infrared sensor, or radio signal controlled or contactless smart card having a computer microchip embedded thereon.

The rear door 20 of the enclosure 14 may also include a lock. However, since the rear door 20 is primarily provided for allowing the homeowner to gain access to the enclosure 14, it is preferably not coupled with the lock operator 24 of the front door 18. Instead, the rear door 20 may be provided with a separate keypad or other entry controlling device for permitting the homeowner to access the enclosure from the rear door 20.

As best illustrated in FIG. 3, the enclosure 14 may also include a conventional door switch 28 operably coupled with the front door 18 for sensing when the front door 18 is opened or closed. The enclosure 14 also preferably includes interior lighting controlled by the door switch 28 for illuminating the inside of the enclosure 14 when either of the doors 18, 20 are opened and an exterior indicator 30 such as an indicating light for indicating when goods have been delivered to and/or picked up from the storage device 10.

As best illustrated in FIG. 4, the lower walls 32 of the enclosure 14 are preferably insulated. A pair of insulated shelf sections 34 are positioned approximately 20" from the bottom of the enclosure 14. The lower insulated walls 32 and the insulated shelf sections 34 define an insulated compartment 36 in the bottom of the storage device 10 for receiving refrigerated or frozen items such as groceries.

The insulated shelf sections 34 are preferably hinged to the sides of the enclosure 14 so that they can be raised for placing the refrigerated items in the insulated compartment 36 or raised for placing larger items in the enclosure 14 when the insulated compartment 36 is not in use. To accommodate both frozen and refrigerated items, the insulated compartment 36 may be sub-divided into a lower freezer section and an upper refrigerator section.

The preferred enclosure 14 also includes a refrigeration unit 38 positioned within the insulated compartment 36 for cooling the compartment 36. The preferred refrigeration unit 38 is a thermoelectric cooling module such as those manufactured by the Tellurex Corporation of Traverse City, Mich. under the Z-MAX tradename.

The refrigeration unit 38 may also be configured as a heater, or the enclosure 14 may include a separate heating unit 40 (see FIG. 5) coupled with the insulated compartment 36 for maintaining the temperature of heated foods such as pizza or other delivered fast food items. Alternatively, the enclosure 14 may include a second, separate insulated compartment (not shown) so that both refrigerated and heated food items can be delivered to the storage device 10 at the same time, or three separate compartments so that refrigerated, heated, and frozen food items can be delivered to the storage device 10.

As best illustrated in FIGS. 3 and 4, the upper portion of the enclosure 14 preferably includes a clothes rod 42 for hanging laundry delivered on hangers. In preferred forms, the enclosure is ventilated so that dry cleaning solvents such as perchloroethylene contained on delivered laundry does not build up within the confines of the enclosure. The enclosure may also include a fan for providing air flow through the ventilation holes. The fan may be a separate unit or may be incorporated in the refrigeration unit 38 or heating unit 40.

The enclosure 14 may also include a pair of shelf sections 44 positioned above the insulated shelf sections 34 but below the clothes rod 42 for holding goods such as grocery sacks. The shelf sections 44 are preferably hinged to the sides of the enclosure 14 so they can be raised when not in use for permitting larger items to be placed in the enclosure 14. Those skilled in the art will appreciate that the shelf sections 44 may be arranged anywhere within the enclosure 14 and the enclosure 14 may include additional interior shelf sections and/or clothes rods.

Figure 5:
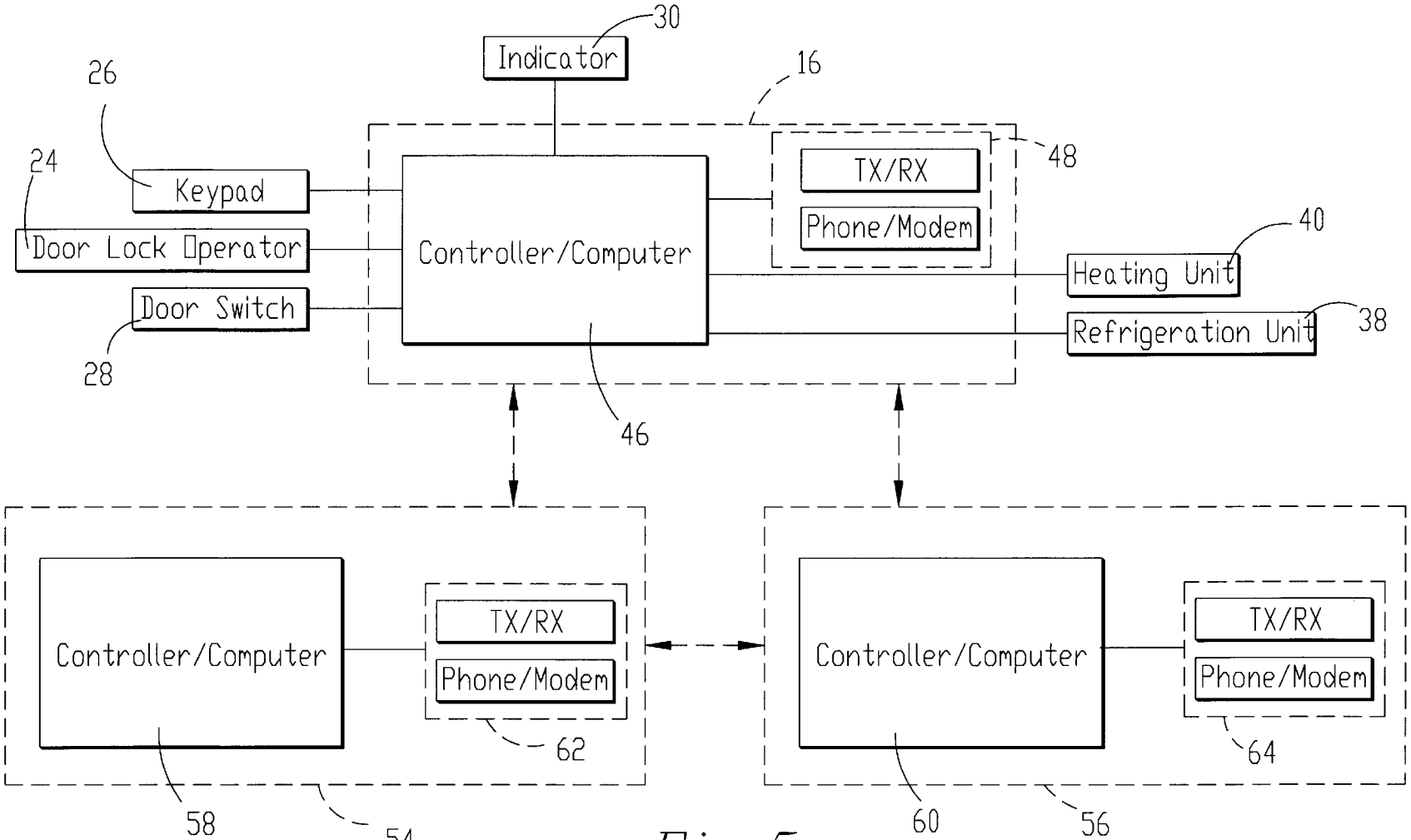
FIG. 5 is a schematic diagram of the communication apparatus of the storage device shown operably coupled with a plurality of remote communication apparatuses.

The communication apparatus 16 is operably coupled with the enclosure 14 for controlling access to the enclosure 14 and for providing notification that goods have been delivered to or picked up from the enclosure 14. As best illustrated in FIG. 5, the preferred communication apparatus 16 includes a controller 46 and a transmitting device 48.

The controller 46 is preferably a conventional programmable logic controller (PLC), a microcomputer or other microprocessor device. The controller 46 may also be a conventional home security system controller such as those manufactured and sold by the ADT Corporation that is programmed to operate as described herein.

The controller 46 has conventional memory for storing a plurality of vendor codes. A unique vendor code is assigned to each vendor that delivers goods to or picks up goods from the storage device 10. For example, a laundry and drycleaning business may be assigned a vendor code of 333, whereas a local grocery store may be assigned a vendor code of 444. Numerous other vendors may also be assigned unique vendor codes. All of these vendor codes are stored in the memory of the controller 46.

For further security, each vendor may also be assigned or may assign each of their delivery people with their own unique employee code. This permits the controller 46 to not only identify which vendor makes deliveries, but also to identify which delivery person employed by the vendor is making the delivery.

A plurality of vendor messages are also stored in the memory of the controller 46. Each vendor message is associated with a particular vendor code. For example, the message "Laundry has been delivered" may be stored in association with the vendor code of 333 for the laundry and dry cleaning business. Similarly, the message "Groceries have been delivered" may be stored in association with the vendor code 444 for the grocery store. The vendor messages may be audio messages stored on a conventional audio tape device such as a phone answering machine coupled with or internal to the controller 46 or may be digitized and stored in the memory of the controller 46.

As illustrated in FIG. 5, the controller 46 is electrically coupled with the keypad 26, the door lock operator 24, the door switch 28 and the indicator 30. As illustrated in FIGS. 2–4, the controller 46 and the other components of the storage device 10 receive electrical power from a conventional source over a wire or wires 50. The storage device 10 may also include a battery for providing backup operation of the device in case of a power failure.

Whenever a key code is entered into the keypad 26, the key code is transmitted to the controller 46. The controller 46 is programmed to compare the entered key code with the stored vendor codes to determine if the entered key code matches any of the stored vendor codes. If it does, the controller 46 directs the lock operator 24 to unlock the door 18. The controller 46 also retrieves the vendor message associated with the matched vendor code. The controller 46 then sends this vendor message to the transmitting device 48.

The transmitting device 48 is responsive to the controller 46 for sending the vendor message to a location remote from the storage device 10. The transmitting device 48 may be any known communication device such as a phone, a programmable answering machine, or a modem configured for sending analog or digital messages over a conventional telecommunications network such as a phone line, a local area network or a wide area network whenever a delivery has been made. As best illustrated in FIG. 4, the transmitting device is coupled with the telecommunications network via cable 52. The transmitting device 48 may also be a radio frequency transmitter/receiver for transmitting the vendor message by radio signals.

Returning to FIG. 5, the controller 46 is also coupled with the refrigeration unit 38. The controller 46 is programed so that whenever a particular vendor code is entered into the keypad, it automatically turns on the refrigeration unit 38. For example, if the vendor code 444 for the grocery store is entered into the keypad, the controller 46 can be programmed to not only unlock the door lock 22 and transmit a vendor message to indicate that a delivery has been made, but to also turn on the refrigeration unit 38. The refrigeration unit 38 may be on a timer so that it runs only a predetermined amount of time or may include a switch that permits the homeowner to turn it off once the goods have been retrieved from the storage device 10.

The controller 46 may also be programmed for receiving a code from the homeowner to turn on the refrigeration unit 38 or the heating unit 40 a predetermined amount of time before a delivery is made. This permits the refrigeration unit 38 or heating unit 40 to cool or heat the interior of the enclosure before the goods are delivered. Alternatively, the vendor may be instructed to phone in or otherwise transmit his vendor code to the controller 46 before delivery is made for turning on the refrigeration unit 38 or heating unit 40.

The controller 46 is also coupled with the indicator device 30 to activate the indicator 30 whenever a delivery has been made. This provides the homeowner with a visual indication of the status of the storage device 10.

The controller 46 may also be equipped with an alarm bell for security. The controller 46 may be programmed to activate the alarm bell if either of the doors 18, 20 of the enclosure 14 are forced open or if a person otherwise tampers with the storage device 10 without first entering a valid vendor code or homeowner code. The controller 46 may also be programmed to send an alarm message to the police or a security company if any of these alarm conditions occur.

As illustrated in FIG. 5, the storage device 10 is preferably part of a delivery system that allows messages to be sent to and received from several locations remote from the enclosure 14. For example, a remote communications apparatus 54 may be placed in the homeowner's home 12 and another remote communication apparatus 56 may be positioned in a vendor's business. The remote communication apparatuses 54, 56 are similar to the communication apparatus 16 and each includes a controller 58, 60 and a transmitting device 62, 64.

In operation, a vendor makes a delivery to the storage device 10 by first entering a keycode into the keypad 26. The controller 46 compares the keycode to the stored vendor codes and unlocks the lock operator 24 only if the keycode matches one of the vendor codes.

If the entered keycode matches a vendor code, the controller 46 also retrieves the vendor message associated with the matched vendor code and sends it to the transmitting device 48 for transmitting to one or both of the remote communication apparatuses 54, 56. The transmitting devices 62, 64 of the remote communication apparatuses 54, 56 receive the vendor message, demodulate or otherwise process the message, and send the message to their respective controllers 58, 60. The remote controllers 58, 60 then display the message or otherwise indicate that a delivery has been made.

The communication apparatus 16 and the remote communication apparatuses 54, 56 may also be configured to permit the homeowner to send a message or notification to a vendor that goods are to be picked up. For this operation, a plurality of unique homeowner codes and a plurality of homeowner messages are stored in the memory of the controller 46. For example, the homeowner code 555 and the homeowner message "Please pick up laundry at XXXX Street" may be stored in the controller 46 for notifying a laundry business that laundry needs to be picked up.

Whenever the homeowner wishes to have goods picked up from the storage device 10, he or she merely enters one of these homeowner codes into the keypad 26. The controller 46 then determines if the entered homeowner code matches one of the stored homeowner codes. If it does, the controller 46 unlocks the lock operator 24, retrieves the homeowner message associated with the homeowner code, and directs the transmitting device 48 to transmit the homeowner message to the appropriate remote communication apparatus 54, 56, i.e., the remote communication apparatus positioned at the appropriate vendor.

The vendor codes, employee codes, and homeowner codes stored in the controller 46 can be changed by either the vendors and/or the homeowner in any conventional manner. Additionally, new codes can be added to the controller 46 and unused codes can be deleted.

The communication apparatus 16 and the remote communication apparatuses 54, 56 may also be configured for permitting the delivery of goods ordered from the Internet. For example, a customer may access a vendor's Internet website in a conventional manner and place an order for the purchase of goods. Along with the order, the customer sends a one-time vendor code that allows the vendor or the vendor's delivery person to deliver the goods to the storage device 10. The controller of the communication apparatus 16 would be programmed to not only unlock the front door 18 upon entry of the vendor code, but to also send a notification message to the customer and a payment message to the vendor to charge or debit the customer's account for the price of the goods.

The communication apparatus 16 may also include memory for storing delivery and pickup information such as a history of the deliveries made to the enclosure 14 and conventional input/output devices for permitting the homeowner to access this information.

Although the invention has been described with reference to the preferred embodiments illustrated in the attached drawing figures, it is noted that equivalents may be employed and substitutions made herein without departing from the scope of the invention as recited in the claims. For example, although the invention has been described and illustrated as being attached to a home, it can be readily modified for attachment to other buildings such as apartments.

Additionally, another embodiment of the invention might include a plurality of storage devices grouped together in a common area of a housing subdivision or an apartment complex, similar to the way mailboxes are grouped in newer subdivisions. The keypad and controller of each of the communication apparatuses would be configured to allow access to each of the storage devices and would direct the vendor, homeowner, or apartment dweller to use whichever storage device was currently empty. The communication apparatuses would then notify the homeowner or apartment dweller to which enclosure the delivery was made.

Having thus described the preferred embodiment of the invention, what is claimed as new and desired to be protected by Letters Patent includes the following:

1. A storage device for the delivery and pick-up of goods, the storage device comprising:

an enclosure for enclosing the goods, the enclosure including a door, a lock for locking the door, and a lock operator for unlocking the lock, the lock operator including a keypad for permitting entry of an alphanumeric key code; and a communication apparatus operably coupled with the enclosure for controlling entry to the enclosure and for providing a notification that goods have been delivered to or picked-up from the enclosure, the communication apparatus including a controller coupled with the keypad, the controller including memory for storing a plurality of vendor codes each associated with a separate vendor, comparing means for comparing the key code to the vendor codes to determine if the key code matches one of the vendor codes, and activating means for activating the lock operator for unlocking the lock if the key code matches one of the vendor codes.

2. The storage device as set forth in claim 1, the controller further including memory for storing a plurality of vendor messages, each of the vendor messages being associated with a respective one of the vendor codes, the comparing means including retrieving means for retrieving the vendor message associated with the vendor code that matches the key code.

3. The storage device as set forth in claim 2, the communication apparatus further including transmitting means responsive to the controller for transmitting the retrieved vendor message to a remote location.

4. The storage device as set forth in claim 3, the transmitting means including a phone and modem coupled with the controller for sending the retrieved message over a telecommunications network.

5. The storage device as set forth in claim 3, the transmitting means including a radio frequency transmitter/receiver coupled with the controller for transmitting the retrieved message to the remote location.

6. The storage device as set forth in claim 1, further including refrigerating means coupled with the enclosure and responsive to the controller for cooling the enclosure when the key code matches a particular vendor code stored in the memory of the controller.

7. The storage device as set forth in claim 1, further including heating means coupled with the enclosure and responsive to the controller for heating the enclosure when the key code matches a particular vendor code stored in the memory of the controller.

8. A storage and delivery system for the delivery and pick-up of goods, the system comprising:

a storage device including an enclosure for enclosing the goods, the enclosure including a door, a lock for locking the door, and a lock operator for unlocking the lock, the lock operator including a keypad for permitting entry of an alphanumeric key code, and a communication apparatus operably coupled with the enclosure for controlling entry to the enclosure and for transmitting a notification message indicating that the goods have been delivered to or picked-up from the enclosure; and a remote communication apparatus positioned remote from the storage device for receiving the notification message for notifying a person that the goods have been delivered to the storage device or picked-up from the storage device;

the communication apparatus including a controller coupled with the keypad, the controller including memory for storing a plurality of vendor codes each associated with a separate vendor, comparing means for comparing the key code to the vendor codes to determine if the key code matches one of the vendor codes, and activating means for activating the lock operator for unlocking the lock if the key code matches one of the vendor codes.

9. The storage device as set forth in claim 8, the controller further including memory for storing a plurality of vendor messages, each of the vendor messages being associated with a respective one of the vendor codes, the comparing means including retrieving means for retrieving the vendor message associated with the vendor code that matches the key code.

10. The storage device as set forth in claim 9, the communication apparatus further including transmitting means responsive to the controller for transmitting the retrieved vendor message to a remote location.

11. The storage device as set forth in claim 10, the transmitting means including a phone and modem coupled with the controller for sending the retrieved message over a telecommunications network.

12. The storage device as set forth in claim 11, the transmitting means including a radio frequency transmitter/receiver coupled with the controller for transmitting the retrieved message to the remote location.

13. The storage device as set forth in claim 8, further including refrigerating means coupled with the enclosure and responsive to the controller for cooling the enclosure when the key code matches a particular vendor code stored in the memory of the controller.

14. The storage device as set forth in claim 8, further including heating means coupled with the enclosure and responsive to the controller for heating the enclosure when the key code matches a particular vendor code stored in the memory of the controller.

15. A storage device for the delivery and pick-up of goods, the storage device comprising:

an enclosure for enclosing the goods, the enclosure including a door, a lock for locking the door, and a lock operator for unlocking the lock, the lock operator including an input device for permitting entry of a code; and a communication apparatus operably coupled with the enclosure for controlling entry to the enclosure, the communication apparatus including a controller coupled with the input device, the controller including means for accessing memory having stored therein a plurality of vendor codes each associated with a separate vendor, comparing means for comparing the code to the vendor codes to determine if the code matches one of the vendor codes, and activating means for activating the lock operator for unlocking the lock if the code matches one of the vendor codes.

16. The storage device as set forth in claim 15, the input device being selected from the group consisting of a keypad, a card reader, a voice recognition device, a fingerprint identification device, and an infrared sensor.

17. The storage device as set forth in claim 15, the controller further including means for accessing memory having stored therein a plurality of vendor messages, each of the vendor messages being associated with a respective one of the vendor codes, the comparing means including retrieving means for retrieving the vendor message associated with the vendor code that matches the code.

18. The storage device as set forth in claim 17, the communication apparatus further including transmitting means responsive to the controller for transmitting the retrieved vendor message to a remote location.

* * * * *